United States Patent [19]

Hitchins

[11] Patent Number: 4,679,366

[45] Date of Patent: Jul. 14, 1987

[54] MODULAR BUILDING COMPONENT

[76] Inventor: William G. Hitchins, "Fiddawn", New Cascade Road, Norfolk Island, Australia 2899

[21] Appl. No.: 758,085

[22] Filed: Jul. 23, 1985

[30] Foreign Application Priority Data

Jul. 23, 1984 [AU] Australia ..... PG6168

[51] Int. Cl.[4] ..... E06B 1/04

[52] U.S. Cl. ..... 52/217; 52/824

[58] Field of Search ..... 52/282, 823–825, 52/217, 308, 484, 768, 476, 213

[56] References Cited

U.S. PATENT DOCUMENTS 3,918,231 11/1975 Kessler ..... 52/824 X

FOREIGN PATENT DOCUMENTS 1509659 6/1969 Fed. Rep. of Germany ..... 52/823
1759190 7/1971 Fed. Rep. of Germany ..... 52/217
2906298 8/1980 Fed. Rep. of Germany ..... 52/217
571145 12/1975 Switzerland ..... 52/217
715737 2/1980 U.S.S.R. ..... 52/217

*Primary Examiner*—Carl D. Friedman
*Assistant Examiner*—Naoko N. Slack
*Attorney, Agent, or Firm*—Anthony A. O'Brien

[57] ABSTRACT

A device is claimed for attaching a frame to an aperture in a wall of a building, comprising a U-shaped female member having a first part of said frame, said female member having a plurality of teeth on the inner side of one limb thereof; and a co-operating male member attachable to a second part of said frame, said male member having a plurality of co-acting teeth on a portion thereof; whereby said male member is insertable into said female member so as to be irreversibly locked in relation thereto when said female and male members are attached to said first and second parts of said frame respectively and said first and second parts fitted together in conventional manner.

3 Claims, 2 Drawing Figures

MODULAR BUILDING COMPONENT

Figure 1:
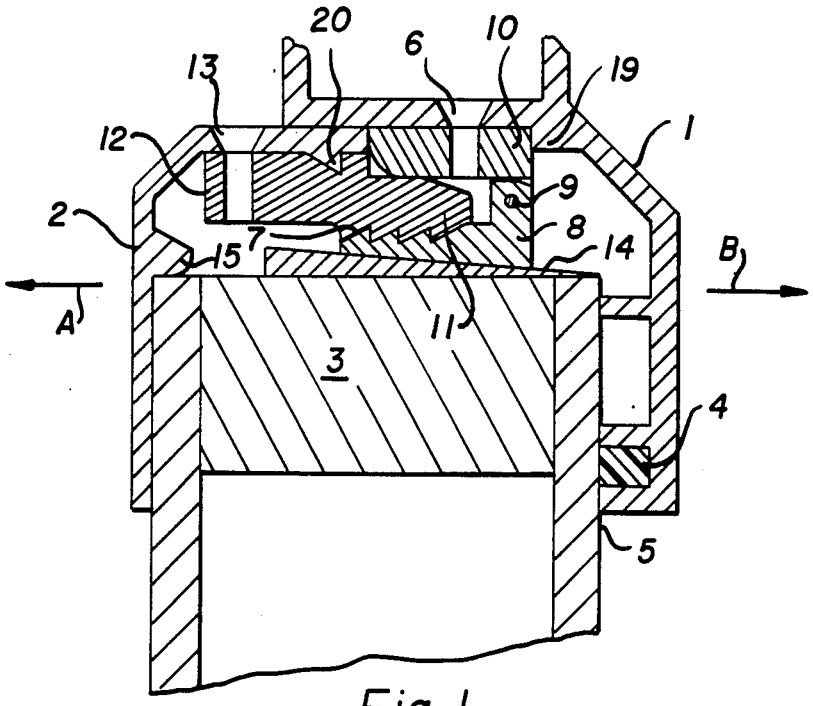

This invention relates to a modular system of building using pre-fabricated elements which are adapted to be assembled on site by semi-skilled persons. In particular, the invention relates to the fixing of detailed structures, such as door-frames and window-frames, with respect to apertures already existing in the wall of a building or the like, and is an improvement on, or a modification of that invention described and claimed in the specification relating to Australian patent application No. 58,061/80.

In that specification there was provided a device for attaching a frame to an aperture in a wall of a building, comprising a U-shaped female member attachable to a first part of said frame, said female member having a plurality of teeth on the inner side of one limb thereof; and a co-operating male member attachable to a second part of said frame, said male member having a plurality of co-acting teeth on a portion thereof; whereby said male member is insertable into said female member so as to be irreversably locked in relation thereto when said female and male members are attached to said first and second parts of said frame respectively and said first and second parts fitted together in conventional manner.

Preferably the above-mentioned male member was provided with a biasing means in the form of a spur which was adapted to bear against the inner side of the other limb of the female member this spur being capable of maintaining the teeth of both male and female members in interlocking engagement but being inwardly compressible to disengage the teeth to permit the male member to be withdrawn from the female member when the male member is detached from the second part of the frame and the second part removed from association with the first part of the frame.

Additionally, the female member was also provided with a spur on the outer side of its toothed limb, this spur projecting outwardly so as to act as a spacer to permit the first portion of the frame to be spaced from the side of the aperture.

In the 'parent' specification, these male and female members were cut from extruded strips of either a suitable plastic material or from hard rubber.

It has now been found that in some cases at least, the above-mentioned spurs on the male and female members may not be wholly effective and therefore it is an object of the present invention to overcome the above and other disadvantages of the device of the 'parent' specification by the provision of an improved device for attaching a frame to an aperture in a wall of a building.

Thus, in accordance with the present invention there is provided a device for attaching a frame to an aperture in a wall of a building, said device comprising a U-shaped female member attachable to a first part of said frame, said female member having a plurality of teeth on the inner side of one limb thereof; and a co-operating male member attachable to a second part of said frame, said male member having a plurality of co-acting teeth on a portion thereof; whereby said male member is insertable into said female member so as to be irreversibly locked in relation thereto when said female and male members are attached to said first and second parts of said frame respectively and the two said parts fitted together;

characterised in that the said one limb of said U-shaped female member and the second limb thereof are pivotally attached one to the other, a portion of the periphery of the said wall aperture having a ramp along which a limb of said female member is adapted to slide when the said first and second parts of the frame are fitted together, to thereby bring the male and female members into locking relationship.

Figure 2:
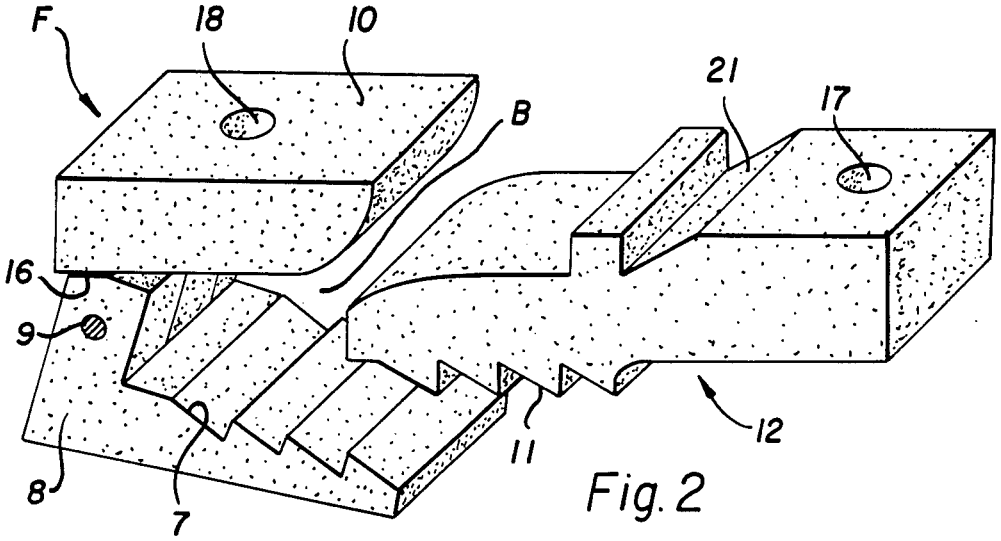

In order that the reader may gain a better understanding of the present invention, hereinafter will be described a preferred embodiment thereof, by way of example only, and with reference to the accompanying drawings in which:

FIG. 1 is a cross section of the device according to the present invention, showing first and second parts of a metal frame in mating relationship; and FIG. 2 is a general orthographic view of the male and female members.

In the drawings, like integers are referenced by the same numerals.

In FIG. 1 is to be seen a metal frame such as a door-frame or window-frame attachable to an aperture in the wall of a building. This metal frame consists in a first part 1 and a second part 2 which are capable of being pushed together or "mated" for attachment about the periphery of an aperture in the wall of a building. For the purposes of clarity in the drawings, a portion of the periphery of this aperture is referenced 3 and represents, say, a cavity wall. Parts 1 and 2 may well be extruded sections, perhaps of aluminum or aluminum alloy or of a suitable plastic material and when "mated" grip the peripheral portions of the aperture; in this regard, part 1 may incorporate a rubber or plastic sealing strip 4 which, when parts 1 and 2 are mated, serves as a weather seal on the outdoor surface 5 of cavity wall 3.

Attachable to part 1 of the frame by means of a countersunk screw 6 is a U-shaped female member F which is provided with a number of teeth 7 on the inner side of one of its limbs 8. As will be seen from FIG. 2 toothed limb 8 is simply pivoted, as with a pivot pin 9, to the other limb 10, which limb 10 is the one attached to part 1 of the frame such that a bight B is formed between the two limbs 8, 10. Teeth 7 of limb 8 co-act with co-operating teeth 11 provided on a male member 12 attachable by a countersunk screw 13 to part 2.

In order to maintain the teeth borne by the male and female members in good interlocking engagement, a certain portion of the periphery of the aperture is provided with a ramp 14 along which limb 8 of the female member is adapted to slide as the parts 1 and 2 of the frame are pushed together.

On the outdoor side of the cavity wall, part 1 of the frame is correctly spaced from the periphery 3 of the aperture by the male and female members and the ramp 14, and needless to say, the other mating part 2 of the frame must also have a corresponding spacing means, and to this end part 2 is provided with such means as a bead 15.

It may sometimes be necessary or desirable to disassemble the frame parts 1 and 2 for any number of reasons, and the present invention allows this to be accomplished with a minimum of labour. When it is desired to proceed with disassembly, screw 13 is removed and part 2 simply pulled away from the wall in the direction of the arrow referenced A. A sharp knock on the screwhole end of male member 12 is then sufficient to cause limb 8 to slide down ramp 14 and allow part 1, together with the male and female members, to be moved away from the wall in the direction of the arrow referenced B. The two limbs of the female member can now be pivoted apart to permit male member 12 to be disengaged.

FIG. 2 is a general orthographic view of the male and female members and should give the reader a better idea of their appearance. It is envisaged that these two members will be made from such as a suitable plastic material, as by moulding, say; upper limb 10 may have a lug on its centre line which is capable of being pivotted between a pair of trunnions provided on lower limb 8. To prevent the two limbs of the female member from gaping too widely when approaching ramp 14, at least one trunnion of limb 8 is shaped, at 16, to constitute a detent. Male and female members are provided with screwholes 17 and 18 respectively and, when they are screwed to parts 1 and 2 of the frame, they are effectively prevented from "skewing" out of alignment by the shoulder 19 on part 1 (see FIG. 1) in the case of the female member, and by the land 20 on part 2 (see FIG. 1) and the trough 21 in the case of male member 12.

The tool suitable for mating the two parts of the frame is that described in Australian patent application No. 58,061/80 with reference to FIG. 5 thereof.

Although the production of the prefabricated parts and elements should be carried out with the usual degree of precision necessary for the interchangeability of parts, the present invention clearly ensures that assembly on site need not be carried out by qualified tradesmen and hence a considerable cost saving may be achieved.

While in the foregoing the two-part frame is described generally in terms of being a metal frame, it may, of course, equally well be of a plastic material, or of such as fibreglass-reinforced resin. Then again, the male and female member components may well be cast from, say, aluminum or some similar material.

It should also be borne in mind that, although the invention has been hereinbefore described with reference to building constructions, it is nevertheless eminently suited, mutatis mutandis, to any kind of assembly involving the mating of co-operating pairs of elements.

From the abovegoing, the reader will readily appreciate that the present invention provides the public with a new or much-improved article or, at the very least, offers to it a useful and most attractive choice.

The claims defining the invention are as follows: We claim:

1. A device for attaching first and second frame parts about opposite sides of the periphery of an aperture in a wall of a building; said device comprising a U-shaped female member having first and second limbs pivotally attached one to the other and each having one inwardly-facing side forming a bight therebetween, a cooperating male member insertable into said bight of said U-shaped female member; means attaching said female member to said frame first part, said female member having a plurality of teeth on said inwardly-facing side of one said limb thereof; means attaching said male member to said second frame part, said male member having a plurality of co-acting teeth on a side thereof; whereby, with said female and male members attached to said first and second frame parts respectively and the said two frame parts fitted together, said male member is received within said bight of said female member so as to be locked therein by means of the mutual engagement of said teeth and co-acting teeth; and a portion of the periphery of the wall aperture having a ramp along which one said limb of said female member is adapted to slide when said frame parts are fitted together to thereby urge the said two members into locking relationship.

2. A device according to claim 1, wherein said male and female member attaching means comprise removable fasteners allowing separation of said members from said frame parts when it is desired to take apart two assembled said frame parts.

3. A device according to claim 1, wherein one of said first and said second frame members further comprises seal strip means for contacting in facing relation an outer surface of one of said opposite sides of said aperture, said seal strip means being maintained in a predetermined degree of compression against said outer surface through the locked engagement of said teeth and said co-acting teeth of said female and male members respectively.

* * * * *